United States Patent [19]

Muraji

[11] Patent Number: 4,709,677

[45] Date of Patent: Dec. 1, 1987

[54] FUEL CONTROL SYSTEM FOR AIR-FUEL MIXTURE SUPPLY DEVICES

[75] Inventor: Tetsuo Muraji, Odawara, Japan

[73] Assignee: Mikuni Kogyo Kabushiki Kaisha, Tokyo, Japan

[21] Appl. No.: 880,877

[22] Filed: Jul. 1, 1986

[30] Foreign Application Priority Data

Jul. 5, 1985 [JP] Japan ..... 60-146627

[51] Int. Cl.[4] ..... F02M 7/18

[52] U.S. Cl. ..... 123/438; 123/439; 261/50.1

[58] Field of Search ..... 261/DIG. 12, 41.3, 41.2, 261/50.2, 50.3; 123/438, 439

[56] References Cited

U.S. PATENT DOCUMENTS

| | | | |
|---|---|---|---|
| 4,201,166 | 5/1980 | Nishimura | 123/438 |
| 4,208,358 | 6/1980 | Atkins | 261/50.1 |
| 4,407,248 | 10/1983 | Takeuchi | 123/438 |
| 4,630,585 | 12/1986 | Maraux | 123/438 |

FOREIGN PATENT DOCUMENTS

| | | | |
|---|---|---|---|
| 56-47649 | 4/1981 | Japan | 123/438 |
| 57-124062 | 8/1982 | Japan | 123/438 |
| 60-43160 | 3/1985 | Japan | 123/438 |

*Primary Examiner*—Ronald B. Cox

*Attorney, Agent, or Firm*—Lalos & Keegan

[57] ABSTRACT

In order to insure that, even when there arises a change in the rate of air flowing through an intake mixture passageway, the air-fuel ratio of the mixture which is to be supplied to an engine is always kept constant, the fuel control system comprises: an intake mixture passageway having a first negative pressure generating section and a second negative pressure generating section provided upstream of the first negative pressure generating section for generating a negative pressure weaker than that in the first negative pressure generating section; a fuel passageway having its one end opening in the first negative pressure generating section and its other end connected to a float chamber via a fuel metering jet; an electromagnetic valve for controlling the rate of the fuel flowing through the fuel passageway; a negative pressure passageway having its one end opening in the second negative pressure generating section and having its other end connected to the fuel passageway at a site located between the fuel metering jet and the electromagnetic valve; and a level detecting means for detecting whether or not the fuel column formed within the negative pressure passageway is at a preset level and capable of generating an electric signal to control the operation of the electromagnetic valve. The first and second negative pressure generating sections are each constructed by a fixed and/or a variable venturi.

16 Claims, 12 Drawing Figures

FUEL CONTROL SYSTEM FOR AIR-FUEL MIXTURE SUPPLY DEVICES

BACKGROUND OF THE INVENTION (a) Field of the Invention:

The present invention relates to a fuel control system for air-fuel mixture supply devices, said system being of the type that there are formed separately and independently relative to each other a negative pressure which serves as the signal of the flow rate of the intake mixture travelling through the intake mixture passageway for supplying a mixture to an engine, and a negative pressure source for the intake of the fuel into the intake mixture passageway.

(b) Description of the Prior Art:

Supposing here, for the convenience of explanation, a carburetor as a simple-structured mixture supplying device as shown generally in FIG. 1, the air-fuel ratio of the mixture formed by the carburetor will theoretically be kept constant despite the fluctuations of the air flow rate. More particularly, in FIG. 1, as air flows in the direction indicated by an arrow 3 through a main intake mixture passageway 1 at a flow rate which is proportional to the degree of opening of a throttle valve 2, a negative pressure proportional to the square of the air flow rate develops in a venturi section 4, while a pressure difference which is proportional to the square of the air flow rate will develop on both sides of a fuel metering jet 5, so that a fuel having a flow rate proportional to the air flow rate is to be supplied into the main intake mixture passageway 1.

In the actual practice, however, the air-fuel ratio is not one which is so simply determined as stated above. That is, a fuel passageway 7 extending from the fuel metering jet 5 to a fuel nozzle 6 which opens into the venturi section 4 has a substantial length relative to the cross-sectional area of the fuel passageway 7, and accordingly, there will develop a resistance of flow of fuel in magnitude proportional (or relative) to the fuel flow rate, or in some cases the flow will become a laminar flow and on some other cases will present a turbulent flow due to the fluctuation of the flow rate owing to the changes in Reynolds number caused by the fluctuations of the flow speed. Moreover, the fuel passageway 7 is not necessarily formed in a straight line, and accordingly the state of flow will not become constant. Also, in case a bleed air is introduced, the flow resistance will exert variations in a complex fashion.

As such, for each different design of carburetor or for each different engine structure which uses a carburetor, there has been the need, in the past, to take time and labor in selecting the size of respective functioning parts which jointly constitute a fuel control system.

In the past, there have been proposed various types of electronically controlled carburetors in an effort to keep the air-fuel ratio of the mixture at a certain theoretical value for all operating conditions. As one such example, there has been known an electronically controlled carburetor which is arranged to effect a duty-control of bleed air via an electromagnetic valve by providing $O_2$ sensor for detecting the oxygen content in the exhaust gas to input, into a computer, the signal which is outputted from this $O_2$ sensor as well as various operating parameters of the engine, so as to be able to determine the fuel flow rate to insure that the air-fuel ratio of the mixture will assume a certain theoretical value by virtue of the output signal coming from the computer as the result of computation performed based on the above-mentioned various inputted data. In such an electronically controlled carburetor as mentioned above which is designed to control the fuel flow rate by feeding back the signals delivered from the $O_2$ sensor, there is the need to input, into respective controlling circuits, a large number of parameters of operation of the engine in order to establish a coincidence between the air-fuel ratio and the theoretical value. Therefore, in addition to the large number of setting-work steps required in the conventional carburetors, there have to be added further work steps for the above said feedback controlling in addition to the conventional setting-work steps. This will bring about an undesirable increase in the number of work steps, leading to an increase in the manufacturing cost. Also, there is known an electronically controlled constant vacuum type carburetor arranged so that the intake mixture flow rate in the main mixture passageway is inputted into the controlling circuit as an electric signal based on the amount of lift of the vacuum piston, to operate an electrostriction vibrator by the output from said controlling circuit, whereby to effect duty-control of the valve-opening time of the main fuel passageway (Japanese Patent Preliminary Publication No. Sho 56-47649). The most obvious problem noted of this type of electronically controlled carburetor lies in that, because of the presence of a frictional resistance on the sliding surface of the vacuum piston, there exists, at a position in the direction of sliding of the vacuum piston, a hysteresis for the negative pressure variations in the variable venturi section and that, therefore, the detection signal of the position of the vacuum piston fails to indicate a correct air flow rate. Also known is an electronically controlled constant vacuum type carburetor arrange so that there are inputted to the controlling circuitry an electric signal based on the amount of lift of the vacuum piston and representing the air flow rate in the main mixture passageway, and also an electric signal based on the difference in pressure between the up-stream side and the down-stream side of main fuel metering jet serving as a feedback signal of the fuel flow rate, so that a stepping motor is driven by the pulse output delivered from said controlling circuitry, whereby the amount of the bleed air is controlled (Japanese Patent Preliminary Publication No. Sho 57-124062). In this latter instance also, the amount of lift of the vacuum piston fails to correctly indicate the air flow rate, just as in the preceding instance mentioned above. Also, in the constant vacuum type carburetor, the negative pressure fluctuations which can take place therein are few, and the pressure difference between the up-stream side and the down-stream side of the main fuel metering jet is controlled mainly by the bleed air flow rate, so that there arises the drawback that the controlling of fuel cannot be performed satisfactorily. Furthermore, there is known a constant vacuum type carburetor arranged so that electric signals based on the temperature of the cooling water, the rotation speed of the engine and the negative pressure of the mixture passageway, respectively, of the engine are inputted to the controlling circuitry, and that by the pulse output delivered from said controlling circuitry, the bleed air is duty-controlled via an electromagnetic valve, whereby to control the fuel flow rate (Japanese Patent Preliminary Publication No. Sho 60-43160). In this instant case, the vacuum piston does not possess a lift amount sensor. However, in spite of the fact that the above-mentioned variance of the amount of lift brings about variance of the negative pressure generated in the variable venturi section which, in turn, is formed by the vacuum piston, there is contained in the inputs delivered to the controlling circuitry no element which compensates for the variance of the negative pressure. Thus, a correct control cannot be expected in this prior art either. Further, in the system disclosed in U.S. Pat. No. 4,201,166, like the present invention, the fuel flow ratio is controlled by utilizing the pressure difference between the fuel pressure in the down-stream side of the main fuel metering jet and the negative pressure in the venturi section, but generally, it cannot be expected to obtain sensors having high precision for detecting the aforesaid pressure difference and besides, the intake of the negative pressure is located in the venturi section in which the main nozzle is opened, and the venturi section is exposed to fuel. Accordingly, this system has the drawback that the fuel enters into the negative pressure passageway and the detection of the negative pressure becomes inaccurate.

SUMMARY OF THE INVENTION

It is therefore, a primary object of the present invention to provide a fuel control system for air-fuel mixture supply devices, arranged so that a fuel having a flow rate proportional to the flow rate of the air travelling through the intake mixture passageway is supplied, whereby even when the flow rate of the air travelling through the intake mixture passageway undergoes a change, the air-fuel ratio of the mixture which is to be supplied to the engine is controlled so as to be held constant.

This object can be attained, according to the present invention, by the provision of an arrangement that, in the intake mixture passageway are provided a first negative pressure generating section and a second negative pressure generating section located upstream relative to the first negative pressure generating section and generating a negative pressure which is lower than that produced in the first negative pressure generating section, and that a fuel passageway having its one end opening into the first negative pressure generating section is connected at its other end via a fuel metering jet to a fuel supply source, and that an electric fuel flow rate controlling means for controlling the flow rate of the fuel which is to flow through the fuel passageway is provided within this fuel passageway, and that a negative pressure passageway having its one end opening into the second negative pressure generating section is connected at its other end to the fuel passageway at a site between the fuel metering jet and the fuel flow rate controlling means, and that there is disposed, close to the negative pressure passageway, a level detecting means capable of generating an electric signal indicative of whether or not the level of the fuel column which ascends through the negative pressure passageway is higher than a preset level by virtue of the difference between the fuel pressure at the region where the negative pressure passageway is connected to the fuel passageway and the negative pressure produced in the second negative pressure generating section. The fuel flow rate controlling means is operated by a signal generated from the level detecting means to control the amount of fuel which is to be supplied to the intake mixture passageway.

Another object of the present invention is to provide a fuel control system which, by being applied to the main fuel system of the fixed venturi type carburetor, makes it possible to always keep constant the air-fuel ratio of the mixture located in the region of medium-to-high degree of opening of the throttle valve.

Still another object of the present invention is to provide a fuel control system which, by being applied to the main fuel system of the constant vacuum type carburetor, makes it possible to always keep constant the air-fuel ratio of the mixture located in the region of medium-to-high degree of opening of the throttle valve, and especially, insures that the possible variance of the amount of lift of the vacuum piston does not give any adverse effect upon the precision of volumetry of the fuel flow rate.

Yet another object of the present invention is to provide a fuel control system which, by being applied to the low-speed fuel system of the constant vacuum type carburetor, makes it possible to always keep constant the air-fuel ratio of the mixture located in the low-opening degree region of the throttle valve.

A further object of the present invention is to provide a fuel control system which insures that the fuel flow rate is not deranged by unidentifiable various complicated factors, and which can substantially reduce the conventionally required various many setting operations.

These and other objects as well as the features and the advantages of the present invention will be apparent from the following detailed description of the preferred embodiments when taken in conjunction with the accompanying drawings.

DETAILED DESCRIPTION OF THE PREFERRED EMBODIMENTS

Figure 1:
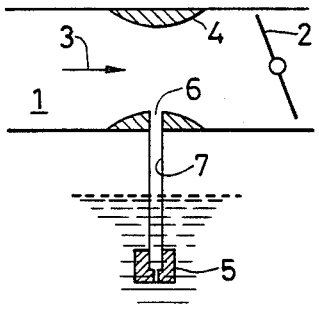
FIG. 1 PRIOR ART
FIG. 1 is a schematic illustration for explaining the basic principle of a carburetor.
Figure 2:
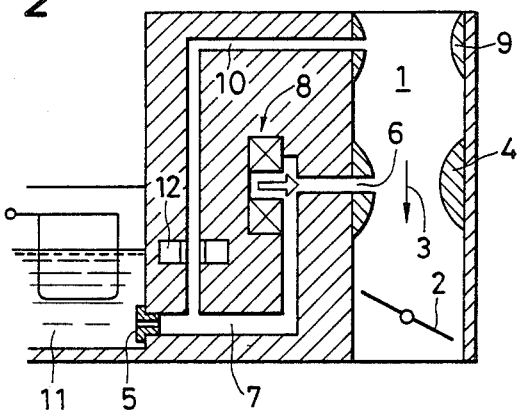
FIG. 2 is a diagrammatic illustration of the basic structure of an embodiment wherein the fuel control system according to the present invention is applied to the main fuel system of the fixed venturi type carburetor.
Figure 3:
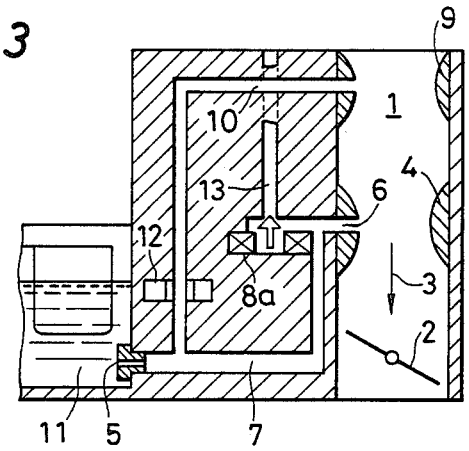
FIG. 3 is a diagrammatic illustration of the basic structure of another embodiment wherein the fuel control system according to the present invention is applied to the main fuel system of the fixed venturi type carburetor.
Figure 4:
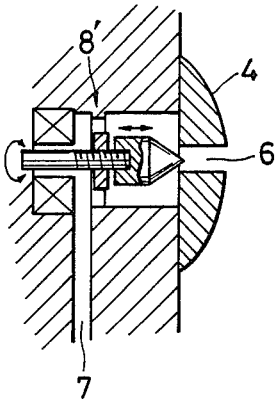
FIG. 4 is a diagrammatic illustration of a stepping motor to be used for controlling the fuel flow rate.

FIGS. 2 and 3 show embodiments wherein the fuel control system of the present invention is applied to the fixed venturi type carburetors, respectively. In FIGS. 2 and 3, reference numeral 1 represents a main intake mixture passageway of the carburetor; 2 a butterfly type throttle valve disposed within the main intake mixture passageway 1; 3 an arrow indicating the direction of the intake mixture flow through the main intake mixture passageway; 4 a fixed venturi; 5 a main fuel jet; 6 a main fuel nozzle opening into the fixed venturi 4; 7 a main fuel passageway communicating between the main fuel jet 5 and the main fuel nozzle 6; 8 a well-known fuel electromagnetic valve disposed in the fuel passageway 7, and it may be of the type of performing duty-control of the opening and closing of the fuel passageway by an electric signal from a later described level detecting means, or it may be of the type of controlling the opening degree of the fuel passageway 7 or performing the opening and closing thereof by the change of the said electric signal. Further, a valve device 8' using a stepping motor or the like as shown in FIG. 4 or the like may be used instead of the electromagnetic valve 8. Numeral 9 represents a fixed venturi disposed on the upstream side of the fixed venturi 4, and a negative pressure passageway 10 opens into the fixed venturi 9, which passageway 10 communicating with the fuel passageway at a location intermediate of the main fuel jet 5 and the fuel electromagnetic valve 8. While the fuel is flowing through the fuel passageway 7, the pressure of the fuel located on the downstream side of the main fuel jet 5 drops proportionally to the square of the flow rate relative to the fuel pressure located on the upstream side of the main fuel jet 5, i.e. than the fuel pressure within a float chamber 11. And, the fuel contained in the fuel passageway 7 is caused to ascend through the negative pressure passageway 10 by virtue of the pressure difference between the fuel pressure located on the downstream side of the main fuel jet 5 and the negative pressure in the fixed venturi 9. Provided on the negative pressure passageway 10 is a means 12 for detecting whether or not the level of the column of the fuel which has ascended through the negative pressure passageway 10 is higher than the preset level (hereinafter this means will be called the level detecting means). This level detecting means 12 may be of the arrangement, for example, that a light-emitting device and a light-receiving device are disposed to face each other, sandwiching said negative pressure passageway 10 therebetween, or it may be a float provided with an electric contact, as will be discussed in further detail later. An electric signal generated by the level detecting means 12 is inputted to the electromagnetic valve 8 via a controlling circuitry which will be described later, and thus the fuel flow rate is controlled.

In FIG. 3, reference numeral 13 represents a bleed air passageway for introducing bleed air into the main fuel passageway 7. An electromagnetic valve 8*a* is disposed in the bleed air passageway 13, so that by controlling the flow rate of the bleed air, the flow rate of the fuel is controlled. In a manner similar to the instance of the electromagnetic valve 8 which is disposed midway in the main fuel passageway 7, an electromagnetic valve 8*a* also may be of the type which is duty-controlled by the electric signal from the level detecting means 12, or of the type arranged to control the degree of opening of the bleed air passageway 13 or performing the opening and closing thereof by the change of the electric signal. Further, the valve device 8' as shown in FIG. 4 may be used in place of the electromagnetic valve 8*a*. Other reference numerals given in FIG. 3 should be understood to indicate like parts designated by like numerals given in FIG. 2.

Figure 5:
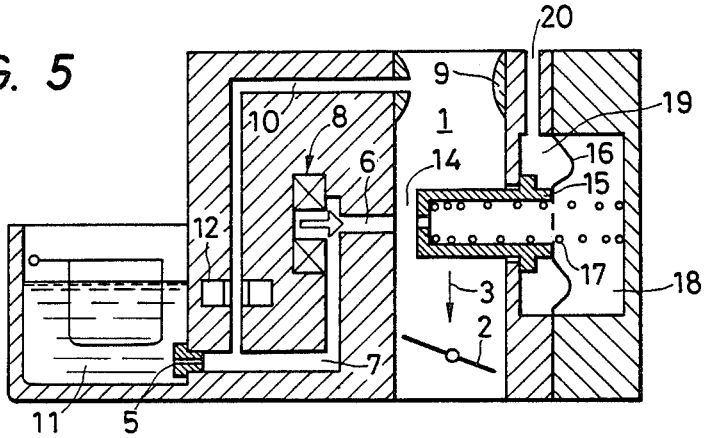
FIG. 5 is a diagrammatic illustration of the basic structure of still another embodiment wherein the fuel control system according to the present invention is applied to the main fuel system of the constant vacuum type carburetor.

FIG. 5 shows an embodiment wherein the fuel control system of the present invention is applied to the main fuel system of the constant vacuum type carburetor. In FIG. 5, numerals 1 to 3 and 5 to 12 indicate like parts designated by like numerals in FIG. 2, and besides, reference numeral 14 represents a variable venturi; 15 a vacuum piston; 16 a negative pressure diaphragm; 17 a spring for urging the vacuum piston 15 in the direction in which the area of opening of the variable venturi 14 becomes minimum. Numeral 18 represents a negative pressure chamber communicating with the variable venturi unit; 19 an atomospheric pressure chamber; and 20 an atmospheric pressure introducing passageway for introducing atmospheric pressure into the atmospheric pressure chamber 19 and has exactly the same structure as that of the instance shown in FIG. 2 with the exception that the main fuel nozzle 6 opens into the variable venturi 14. Also, though not shown in the drawings, an arrangement may be provided so that, in place of disposing the electromagnetic valve 8 in the main fuel passageway 7, a bleed air passageway 13 may be provided and an electromagnetic valve 8*a* may be disposed in the bleed air passageway 13 as in the case of FIG. 3. Furthermore, as shown in FIG. 6, in order to form a variable venturi 14, arrangement may be provided so that a plate valve 21 is installed in place of the vacuum piston 15, and this plate valve 21 is coupled to negative pressure diaphragm 16 via a lever 22 and a coupling rod 23, so as to have the negative pressure chamber 18 communicate with the variable venturi section 14 via a passageway 24, whereby it becomes possible to provide a constant vacuum type carburetor similar to that shown in FIG. 5.

Figure 6:
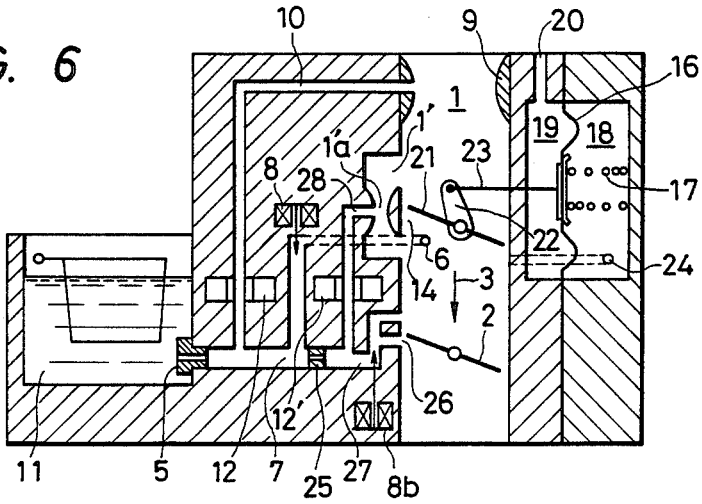
FIG. 6 is a diagrammatic illustration of the basic structure of yet another embodiment wherein the fuel control system according to the present invention is applied to the main fuel system of the constant vacuum type carburetor.

Further, FIG. 6 shows an embodiment wherein the fuel control system of the present invention is also applied to the low-speed fuel system which differs from that described later referring to FIG. 7. That is to say, in this low-speed fuel system, between the up-stream side and the down-stream side of the plate valve 21 is provided a bypass air passageway 1' having a slow venturi 1'*a* into which a low-speed negative pressure passageway 28 opens. A slow controlling electromagnetic valve 8*b* is operated on the basis of electric signals issued from a slow level detecting means 12' in the same manner as in the control of the main fuel system. In FIG. 6, reference numerals 1 to 3, 5 to 8, 11 and 12, and 17 represent like parts indicated by like reference numerals in FIG. 5. Numeral 25 represents a low-speed fuel jet, numeral 26 represents a low-speed nozzle, and numeral 27 denotes a low-speed fuel passageway communicating between the low-speed fuel jet 25 and the low-speed nozzle 26.

Figure 7:
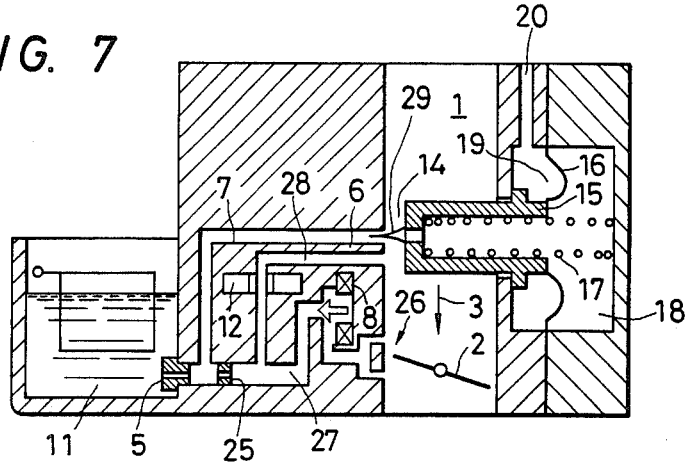
FIG. 7 is a diagrammatic illustration of the basic structure of a further embodiment wherein the fuel control system according to the present invention is applied to the low-speed fuel system of the constant vacuum type carburetor.

FIG. 7 shows an embodiment wherein the fuel control system of the present invention is applied to the low-speed fuel system of the constant vacuum type carburetor. In this embodiment of FIG. 7, it should be noted that the fuel control system of the present invention is not applied to the main fuel system. In FIG. 7, reference numerals 1 to 3, 5 to 8, 11 and 12, and 14 to 20 represent like parts indicated by like reference numerals in FIG. 5. Numeral 25 represents a low-speed fuel jet, and numeral 26 denotes a low-speed nozzle. The low-speed nozzle 26 opens into a negative pressure generating section which is formed by the outer peripheral edge of the butterfly type throttle valve 2 and by the inner circumferential surface of the main intake mixture passageway 1. In FIG. 7, the low-speed nozzle 26 is formed by two openings consisting of a bypass port and a pilot outlet. This nozzle 26, however, may be formed with a single bore. Numeral 27 represents a low-speed fuel passageway communicating between the low-speed fuel jet 25 and the low-speed nozzle 26, and there is disposed an electromagnetic valve 8 midway of this passageway. Numeral 28 denotes a negative pressure passageway opening at its one end into the variable venturi section 14, and at its other end, into the low-speed fuel passageway 27 at a site between the low-speed fuel jet 25 and the electromagnetic valve 8, and there is disposed a level detecting means 12 in this passageway 28. In the low opening degree region of the butterfly type throttle valve 2 which is acted upon by the low-speed nozzle 26, the vacuum piston 15 is held at the position of the minimum opening degree of this throttle valve, and accordingly the variable venturi 14 functions as a fixed venturi which serves as the negative pressure supply source intended to generate an air flow rate signal. In the embodiment shown in FIG. 7 also, as in the embodiment of FIG. 3, it is possible to provide an arrangement that a bleed air passageway is made to communicate with the low-speed fuel passageway, and that an electromagnetic valve 8*a* is disposed in said bleed air passageway, so that, by controlling the bleed air, the low-speed fuel rate is controlled. Here, numeral 29 represents a metering needle. Accordingly, in this system, the fuel control of the main fuel system is performed by the metering needle 29 as in the conventional manner. However, it is needless to say that the fuel control system of the present invention may be also used in place of this main fuel system.

Figure 8:
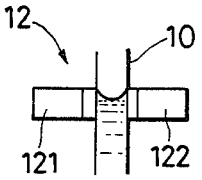
FIGS. 8 to 10 are diagrammatic enlarged partial illustrations showing mutually different concrete examples of level detecting means.
Figure 9:
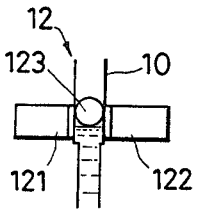
Figure 10:
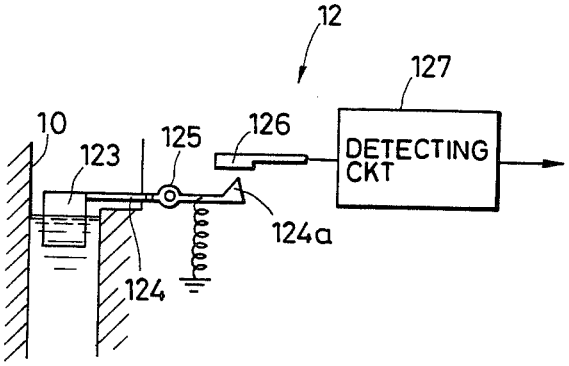

Next, description will be hereunder made of a further detailed structure of the level detecting means which is indicated by reference numeral 12 in FIGS. 2, 3, 5 to 6, by giving reference to FIGS. 8 to 10. In FIGS. 8 to 10, reference numeral 121 represents a light-emitting device, and 122 a light-receiving device which is disposed to face the light-emitting device 121 via a negative pressure passageway 10 interposed therebetween. When the above said level of the fuel column contained in the negative pressure passageway 10 is positioned at least at the present level, that specific portion of the fuel column located at its upper end position is formed with a transparent body. In the structure shown in FIG. 8, it should be noted that, when the fuel column is positioned at a level lower than the preset level, the light which emits from the light-emitting device 121 is caused to scatter during its travel through the negative pressure passageway 10, and as a result, the electromotive power which is generated by the light-receiving device 122 becomes reduced, whereas when the fuel column ascends by surpassing the preset level, the light coming from the light-emitting device 121 will be collected onto the light-receiving device 122, and accordingly the light-receiving device 122 will generate a large electromotive power. In the structure of FIG. 9, a float 123 which is made of an opaque material is provided to float on the top surface of the fuel column. When the level of the fuel column is at a position lower than the preset level, the float 123 will completely block the space between the light-emitting device 121 and the light-receiving device 122. Therefore, the electromotive power which is generated in the light-receiving device 122 will become almost zero. On the other hand, when the level of the fuel column head is at a position above the predetermined level, a large electromotive power will be generated in the light-receiving device 122. Further, in the structure of FIG. 10, the float 123 is secured to one end of an arm 124 which, in turn, is rotatably supported on an axis 125, and the other end 124*a* of this arm 124 is constructed in the form of a movable contact. A fixed contact 126 which is connected to a detecting circuitry 127 is positioned so as to face said movable contact 124*a*. In this instant structure also, as in the structure of FIG. 8, it should be noted that, when the fuel column is at a position of at least the preset level, the movable contact 124*a* parts away from the fixed contact 126 as illustrated, and as a result, a high-level output is delivered from the detecting circuitry 127. On the other hand, when the level of the fuel column is lower than the preset level, the arm 124 undergoes a counter-clockwise rotation, so that the movable contact 124*a* will be brought into contact with the fixed contact 126. As a result, a low-level output is generated from the detecting circuitry 127. In case the float is used as in the structures of FIGS. 9 and 10, it is favourable to provide stoppers for delimiting the upper and lower limit positions of the movement of the float to enable to prevent the operation of the electromagnetic valve or stepping motor valve from disorder.

Description will be made later of the interaction of the level detecting means 12 and the electromagnetic valve 8, 8*a* or 8*b* which constitutes the fuel flow rate controlling means.

Hereunder will be described the function of the fuel control system according to the present invention.

In case the fuel control system of the present invention is applied to either one of the following fuel systems, i.e. the main fuel system of the fixed venturi type carburetor, the main fuel system of the constant vacuum type carburetor, and the low-speed fuel system, the function of this fuel control system to keep the air-fuel ratio constant is invariably the same. Accordingly, the function will be described typically of the embodiment in which the present invention is applied to the fixed venturi type carburetor shown in FIG. 2. The principle that, by the adoption of the fuel system of the present invention, the air-fuel ratio can be always held constant despite possible fluctuations in the air flow rate lies in that the fuel flow rate is controlled by a fuel flow rate controlling means (electromagnetic valve 8, 8*a* or 8*b*) in such a manner that the fuel pressure on the downstream side located immediately behind the fuel metering jet (which, in the main fuel system, is comprised of the main fuel jet 5; and in the low-speed fuel system, it is comprised of the low-speed fuel jet 25 will faithfully follow the negative pressure of the fixed venturi section 9 which correctly represents the air flow rate. Since there is no flow of fuel within the negative pressure passageway 10 or 28 which opens in either the fixed venturi section 9 or the variable venturi section 14, a fuel flow rate control with constant air-fuel ratio can be realized by controlling the fuel flow rate in such a way as to keep, at a constant level, the fuel column which ascends through the negative pressure passageway 10 or 28. The course or process of this control will hereunder be described more concretely.

When the level of the fuel column ascending through the negative pressure passageway 10 is lower than the preset level, i.e. in case, as discussed above, the rate of flow of the fuel running through the fuel passageway is large and thus when the fuel pressure is rendered lower than the preset value, this means that the fuel flow rate is excessively large relative to the air flow rate corresponding to the negative pressure generated in the fixed venturi 9, and accordingly the mixture is rendered exceedingly rich. On the other hand, since the light which impinges onto the light-receiving device 122 of the level detecting means 12 has become weak as stated above, the electromotive power of the light-receiving device 122 is small.

Figure 11:
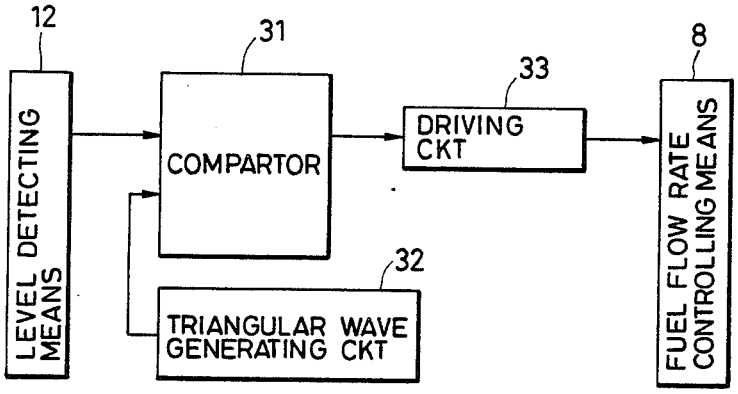
FIGS. 11 and 12 are block diagrams showing mutually different controlling circuitries.

In the controlling circuit structure shown in FIG. 11, arrangement is provided so that its comparator 31 is normally inputted with an output generated by a triangular wave generator 32 to insure the operation such that, when the signal voltage (i.e. the electromotive power of the light-receiving device 122) of the level detecting means 12 is low, the comparator 31 will output a pulse having a narrow pulse width. Therefore, the duty factor of the fuel flow rate controlling means (electromagnetic valve 8) becomes small, leading to a reduction in the fuel flow rate which, in turn, brings about a small difference in pressure between the upstream side and the down-stream side of the main fuel jet 5, causing an elevation of the pressure, on the down-stream side, of the main fuel metering jet 5 (i.e. the negative pressure will become weak), whereby raising the level of the fuel column.

In case the fuel column level within the negative pressure passageway 10 is higher than the preset level, i.e. when the flow rate of the fuel running through the fuel passageway is small, and accordingly when the fuel pressure has become higher than the preset value, the fuel flow rate is exceedingly small relative to the air flow rate corresponding to the negative pressure generated in the fixed venturi 9, so that the mixture is rendered excessively lean. In this case, as will be apparent from the description made above, the signal voltage (the electromotive power of the light-receiving device 122) of the level detecting means 12 augments so that the pulse width of the pulse generated by the comparator 31 of the controlling circuitry of FIG. 11 becomes large, causing the duty factor of the fuel flow rate controlling means (electromagnetic valve 8) is augmented, causing an increase in the fuel flow rate. As a result, the fuel pressure becomes lowered, and accordingly the fuel column level becomes lowered also.

The above-described functions are alternately repeated, and thus the air-fuel ratio can be always kept constant even when the rate of flow of the air travelling through the main intake mixture passageway 1 undergoes a change.

Figure 12:
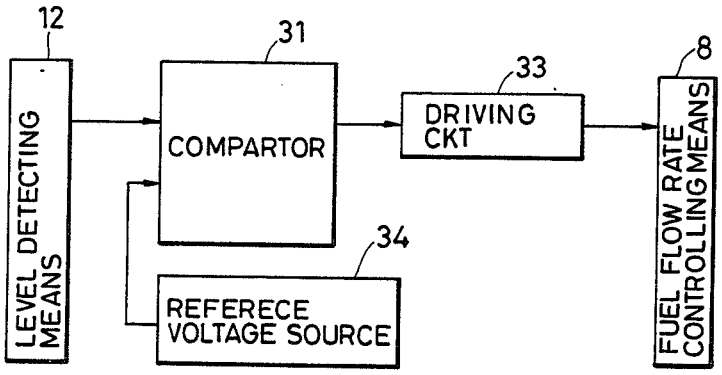

In the controlling circuitry shown in FIG. 12, a reference voltage power supply 34 is connected to the comparator 31, in place of the triangular wave generating circuit 32 in FIG. 11, and, by virtue of the variation of the signal voltage (the electromotive power of the light-receiving device 122) of the fuel pressure detecting means 12, the controlling of the opening and closing of the fuel flow rate controlling means (electromagnetic valve 8) is performed. The fuel flow rate controlling means (electromagnetic valve 8) does not necessarily need to be the type designed for effecting complete opening and closing, and it may be of the type designed to perform changeover between two mutually different opening sizes. Further, the valve device 8' which is driven by the stepping motor as shown in FIG. 4 may be used in place of the electromagnetic valves 8, 8*a* and/or 8*b*. That the fuel flow rate can be controlled by bleed air as in the case of FIG. 3 is a technique usually employed in the electronically controlled carburetors, and therefore its explanation is omitted.

In FIG. 5, there has been shown the instance wherein the fuel control system of the present invention is applied to the constant vacuum type carburetor. In the structure of FIG. 5, however, unlike conventional constant vacuum type carburetors, a metering needle which otherwise is to be attached to the vacuum piston 15 is not inserted in the main fuel nozzle 6. In the conventional constant vacuum type carburetor, it should be noted that, in case the throttle valve 2 is opened and thus the air flow rate is increased, the vacuum piston 15 will be caused to ascend with an increase in the negative pressure existing in the vicinity of the variable venturi 14, with the result that the negative pressure in the vicinity of the variable venturi 14 is weakened, so that the region of the variable venturi 14 is kept at a constant negative pressure. And, the surrounding gap existing between the metering needle attached to the negative pressure piston 15 and the main fuel nozzle 6 into which this metering needle is inserted will undergo an increase and decrease, and thus the rate of the fuel flowing out is controlled. In this case, when the vacuum piston 15 makes vertical movements in respect to the intake mixture passageway 1, it should be noted that, if these movements of the vacuum piston fail to follow the changes arising in the negative pressure at the variable venturi section 14 owing to the ambient sliding-oriented resistances and other reasons, there will arise variance in the rate of fuel flowing out from the main fuel nozzle 6, and thus the air-fuel ratio will not become constant. In contrast thereto, in the present invention, unlike the above-mentioned type which uses a metering needle, arrangement is provided so that the fuel flow rate is controlled by operating the flow rate controlling means based on the balance between the negative pressure of the fixed venturi 9 provided upstream of the variable venturi section 14 and the pressure of the fluid flowing through the fuel passageway. Therefore, the present invention displays a remarkable advantage that, even when there arises variance in the amount of lift of the vacuum piston 15, the air-fuel ratio can be always kept constant. It is needless to say that the fuel system of the present invention can be applied to the conventional type carburetors wherein a metering needle is attached to the vacuum piston 15 and the metering needle is inserted into the main fuel nozzle 6. In this case, however, the provision of this needle is intended mainly for the improvement of atomization, and it has nothing to do with the controlling of the flow rate. The above-mentioned advantage will be displayed equally prominently in the embodiment shown in FIG. 5. More particularly, even when there arises variation in the opening degree of the plate valve 21, the air-fuel ratio can be kept constant.

Also, as has been described already by referring to FIG. 7, it should be noted that, in the constant vacuum type carburetor, it is possible to apply the fuel control system according to the present invention to the low-speed fuel system and to maintain constant the air-fuel ration at the time of a low opening degree. While the position of the vacuum piston of the constant vacuum type carburetor will develop changes at the time of medium-to-high opening degrees, due to hysteresis for the changes in the negative pressure of the variable venturi 14, it should be noted that for low opening degrees, the minimum opening degree is held constant, so that it is possible to have this piston function as a fixed venturi which generates a negative pressure which, in turn, serves as an air flow rate signal. As such, since in the low opening degree region, the negative pressure applied to the main fuel nozzle 6 is weak, and accordingly since there is hardly any flow-out of fuel from the main fuel nozzle 6, it is possible to hold the air-fuel ratio constant by controlling, in a manner described above, the flow rate of the fuel coming from the low-speed fuel system.

As described above, the fuel control system according to the present invention is provided with a first negative pressure generating section and a second negative pressure generating section and arranged so that the intake negative pressure produced at the second negative pressure generating section is utilized to control the fuel flow rate. Therefore, the fuel emitted from the main nozzle will almost never enter into the negative pressure passageway. And since the negative pressure to be detected is introduced from an independent venturi section located apart from the throttle valve, the venturi section will be kept clean without being polluted with back fire of the engine and as the result, the detection of the negative pressure will be always performed accurately. Further, according to the present, since the level of the fuel column within the negative pressure passageway is detected directly, the precision of the detection will not be affected even if the fuel inters into the negative pressure passageway. Furthermore, since the level of the fuel column can be measured with the precision higher than water head $\pm 1$ mm, the level detecting signal to be used as the control signal is good in response and high in precision.

What is claimed is:

1. A fuel control system for air-fuel mixture supply devices, comprising:

an intake mixture passageway having a first negative pressure generating section and a second negative pressure generating section disposed upstream of said first negative pressure generating section for generating a negative pressure weaker than that generated in said first negative pressure generating section;

a fuel passageway having its one end opening in said first negative pressure generating section of said intake mixture passageway and having its other end connected, via a fuel metering jet, to a fuel supply source;

a first electric fuel flow rate controlling means provided in association with said fuel passageway for controlling the flow rate of the fuel which should flow through said fuel passageway;

a negative pressure passageway having its one end opening into said second negative pressure generating section of said intake mixture passageway and having its other end connected to said fuel passageway at a site located between said fuel metering jet and said electric fuel flow rate controlling means; and a level detecting means disposed at a site close to said negative pressure passageway and capable of generating an electric signal indicative of whether or not the level of the fuel column ascending through the negative pressure passageway is higher than a preset level by virtue of a difference between a fuel pressure in the region where said negative pressure passageway is connected to said fuel passageway and a negative pressure produced in said second negative pressure generating section, said first fuel flow rate controlling means being operated by a signal generated by said level detecting means, in order to control the rate of flow of the fuel which is to be supplied into said intake mixture passageway from said fuel passageway.

2. A fuel control system according to claim 1, in which:

said first and second negative pressure generating sections are formed as fixed venturis, respectively, said fuel passageway is a main fuel passageway having a main fuel nozzle, and said fuel metering jet is a main fuel jet.

3. A fuel control system according to claim 1, in which:

said first negative pressure generating section is formed as a variable venturi controlled by a vacuum piston, said second negative pressure generating section is formed as a fixed venturi, said fuel passageway is a main fuel passageway having a main fuel nozzle facing the bottom face of said vacuum piston, and said fuel metering jet is a main fuel jet.

4. A fuel control system according to claim 1, in which:

said first negative pressure generating section is formed by a plate valve provided in said intake mixture passageway and being capable of altering its own opening degree in accordance with fluctuations of the negative pressure in said first negative pressure generating section in order to maintain, at a constant value, the negative pressure generated in said first negative pressure generating section, said second negative pressure generating section is formed as a fixed venturi, said fuel passageway is a main fuel passageway having a main fuel nozzle provided between a site downstream of said plate valve and a throttle valve, and said fuel metering jet is a main fuel jet.

5. A fuel control system according to claim 3, in which:

said first negative pressure generating section is formed by a butterfly type throttle valve provided at a position of a low opening degree, said second negative pressure generating section is formed by a vacuum piston held at a minimum opening degree, said vacuum piston has a metering needle inserted into a main fuel nozzle opening in the inner circumferential surface of said intake mixture passageway, said fuel passageway is a low-speed fuel passageway having a low-speed nozzle disposed adjacent to the peripheral edge portion of said throttle valve, and said fuel metering jet is a low-speed fuel jet.

6. A fuel control system according to claim 4 further comprising:

a bypass air passageway provided between the upstream side and the down-stream side of said plate valve and having a slow venturi section therein, a low-speed negative pressure passagewawy having its one end opening into said slow venturi section of said bypass air passageway and having its other end connected to a low-speed fuel passageway communicating with said fuel passageway via a low-speed fuel jet, a slow level detecting means disposed at a site close to said low-speed negative pressure passageway and capable of generating an electric signal indicative of whether or not the level of the fuel column ascending through the low-speed negative pressure passageway is higher than a preset level by virtue of a difference between a fuel pressure in the region where said low-speed negative pressure passageway is connected to said low-speed fuel passageway and a negative pressure produced in said slow venturi section, a low-speed nozzle opening into a negative pressure generating section to be formed by the outer peripheral edge of a throttle valve and by the inner circumferential surface of said intake mixture passageway, and a second electric fuel flow rate controlling the flow rate of the fuel to flow through said low-speed fuel passageway, said second flow rate controlling means being operated by a signal generated by said slow level detecting means, in order to control the rate of flow of the fuel to be supplied into said intake mixture passageway from said low-speed nozzle.

7. A fuel control system according to claim 1, in which:

said first fuel flow rate controlling means is an electromagnetic valve being duty-controlled by an electric signal produced based on a signal delivered from said level detecting means in order to open and close said fuel passageway.

8. A fuel control system according to claim 1, in which:

said first fuel flow rate controlling means is an electromagnetic valve being duty-controlled by an electric signal produced based on a signal delivered from said level detecting means in order to open and close a bleed air passageway connected to said fuel passageway.

9. A fuel control system according to claim 1, in which:

said first fuel flow rate controlling means is an electromagnetic valve controlled to perform a changeover of a cross-sectional area of said fuel passageway between mutually different two sizes by virtue of a change in an electric signal produced based on a signal delivered from said level detecting means.

10. A fuel control system according to claim 1, in which:

said first fuel flow rate controlling means is an electromagnetic valve controlled to perform a changeover of a cross-sectional area of a bleed air passageway connected to said fuel passageway between mutually different two sizes by virtue of a change in an electric signal produced based on a signal delivered from said level detecting means.

11. A fuel control system according to claim 1, in which:

said first fuel flow rate controlling means is an electromagnetic valve which proportionally controls the opening degree of said fuel passageway by a change in an electric signal produced based on a signal delivered from said level detecting means.

12. A fuel control system according to claim 1, in which:

said first fuel flow rate controlling means is an electromagnetic valve which proportionally controls the opening degree of a bleed air passageway connected to said fuel passageway, by virtue of a change in an electric signal produced based on a signal delivered from said level detecting means.

13. A fuel control system according to claim 1, in which:

said first fuel flow rate controlling means is a control valve, being driven by a stepping motor, which proportionally controls the opening degree of said fuel passageway by a change in an electric signal produced based on a signal delivered from said level detecting means.

14. A fuel control system according to claim 1, in which:

said first fuel flow rate controlling means is a control valve, being driven by a stepping motor, which proportionally controls the opening degree of a bleed air passageway connected to said fuel passageway, by virtue of a change in an electric signal produced based on a signal delivered from said level detecting means.

15. A fuel control system according to claim 1, in which:

said level detecting means comprises a light-emitting device and a light-receiving device which are disposed to face each other at a position of a preset level via said negative pressure passageway interposed therebetween.

16. A fuel control system according to claim 1, in which:

said level detecting means is a float chamber connected to said negative pressure passageway and provided, in said chamber, with an electric contact.

* * * * *